US006524272B1

(12) United States Patent
Berry, Sr.

(10) Patent No.: US 6,524,272 B1
(45) Date of Patent: Feb. 25, 2003

(54) BABY SAFE FEEDER WITH INTEGRAL MESH BAG

(76) Inventor: Donald P. Berry, Sr., 391 Magnolia Pl., DeBary, FL (US) 32713

( * ) Notice: Subject to any disclaimer, the term of this patent is extended or adjusted under 35 U.S.C. 154(b) by 69 days.

(21) Appl. No.: 09/588,360

(22) Filed: Jun. 7, 2000

(51) Int. Cl.[7] ..... A61J 7/00
(52) U.S. Cl. ..... 604/77
(58) Field of Search ..... 604/19, 57, 77, 604/79, 82, 264, 403, 408; 215/273, 274, 276, 277, 283, DIG. 3; 220/253, 256, 288; 606/234–236

(56) References Cited

U.S. PATENT DOCUMENTS

| | | | | |
|---|---|---|---|---|
| 1,095,264 | A | | 5/1914 | Bridges |
| 3,076,574 | A | | 2/1963 | Woodbury, Jr. |
| 3,610,248 | A | | 10/1971 | Davidson |
| 4,192,307 | A | | 3/1980 | Baer |
| 5,078,734 | A | | 1/1992 | Nobel |
| 5,123,915 | A | | 6/1992 | Miller et al. |
| 5,176,705 | A | | 1/1993 | Nobel |
| 5,364,348 | A | | 11/1994 | Berry, Sr. |
| 6,080,027 | A | * | 6/2000 | Rodemann ..... 441/41 |

* cited by examiner

*Primary Examiner*—Michael J. Hayes
(74) *Attorney, Agent, or Firm*—Julian C. Renfro, Esq.

(57) ABSTRACT

A device for feeding a young child or impaired adult without the threat of the person choking, this device comprising a handle member in combination with an elongate food dispensing container of mesh material, with the end of the container having an aperture permitting semi-solid food to be inserted therein. An end of the handle member has external threads, and an internally threaded ring is utilized in cooperation therewith. One of the embodiments of this invention involves the internally threaded ring being a part of a ring assembly constituted by inseparable inner and outer interlocking ring portions, with the part of the food dispensing container locked tightly therebetween, whereas another embodiment involves a rigid ring permanently secured in the end of the food dispensing container.

11 Claims, 2 Drawing Sheets

FIG 1
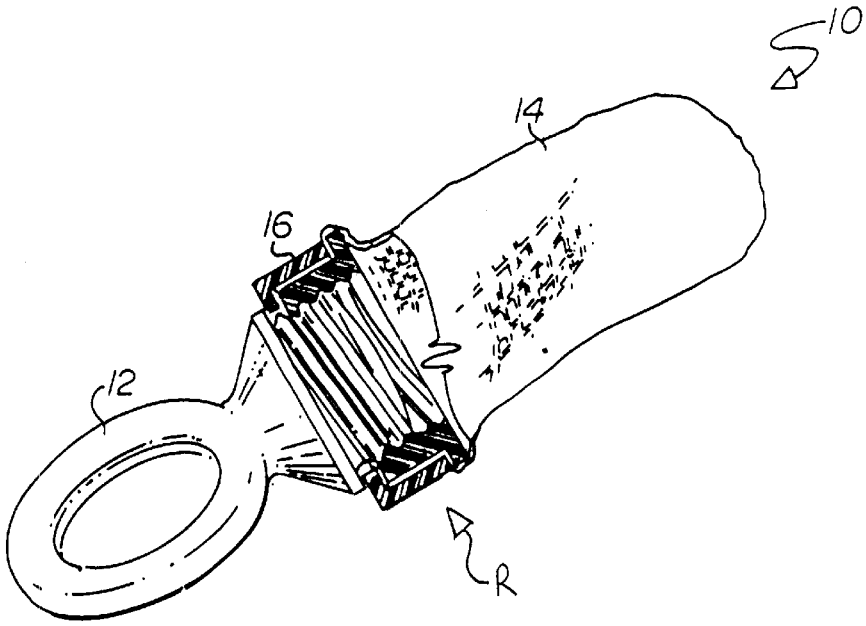
FIG 2
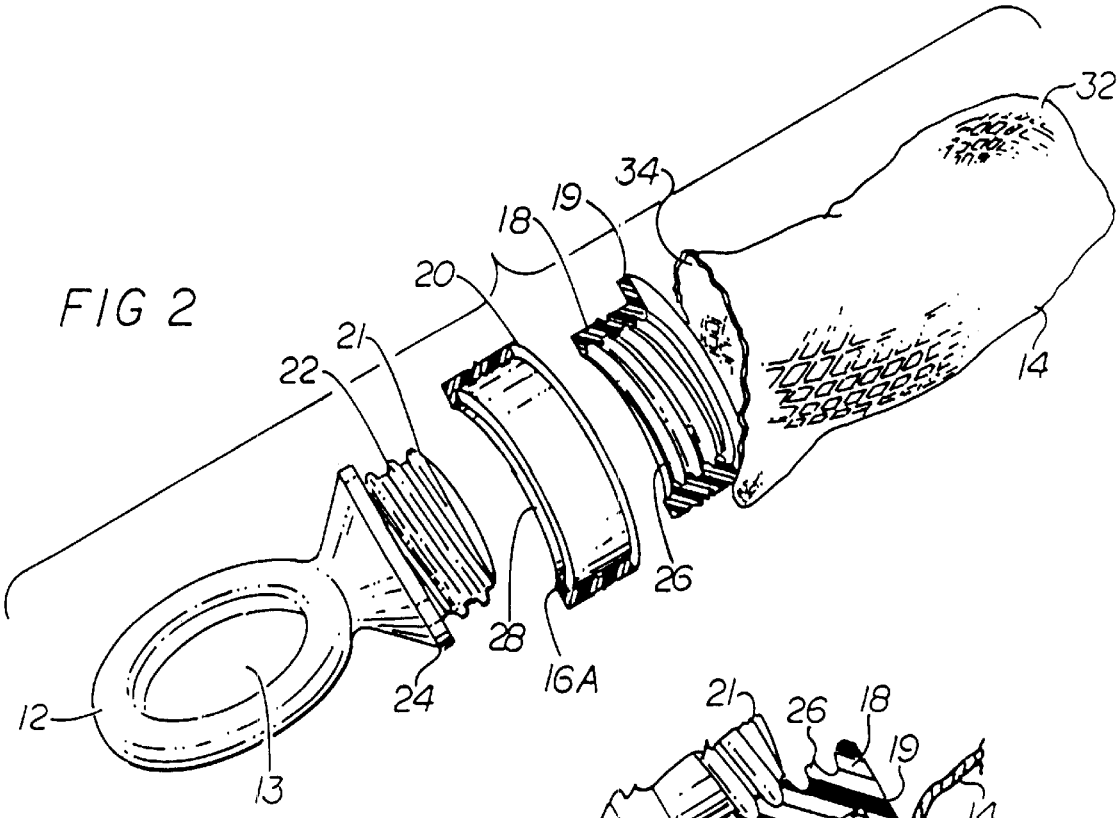
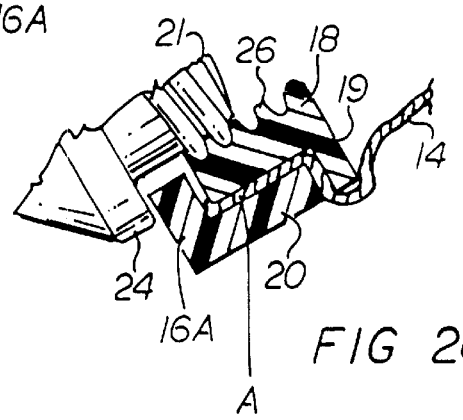
FIG 2a

FIG 3
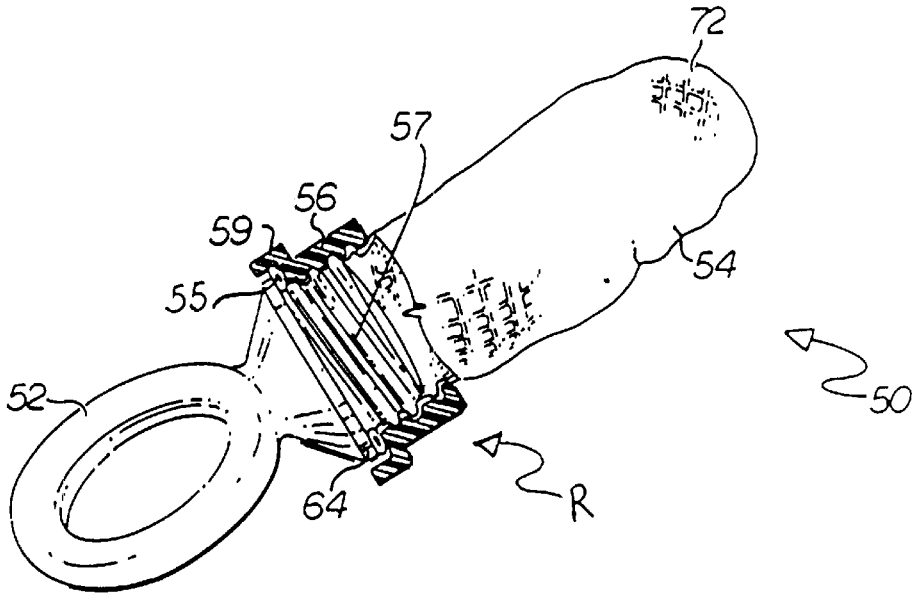
FIG 4
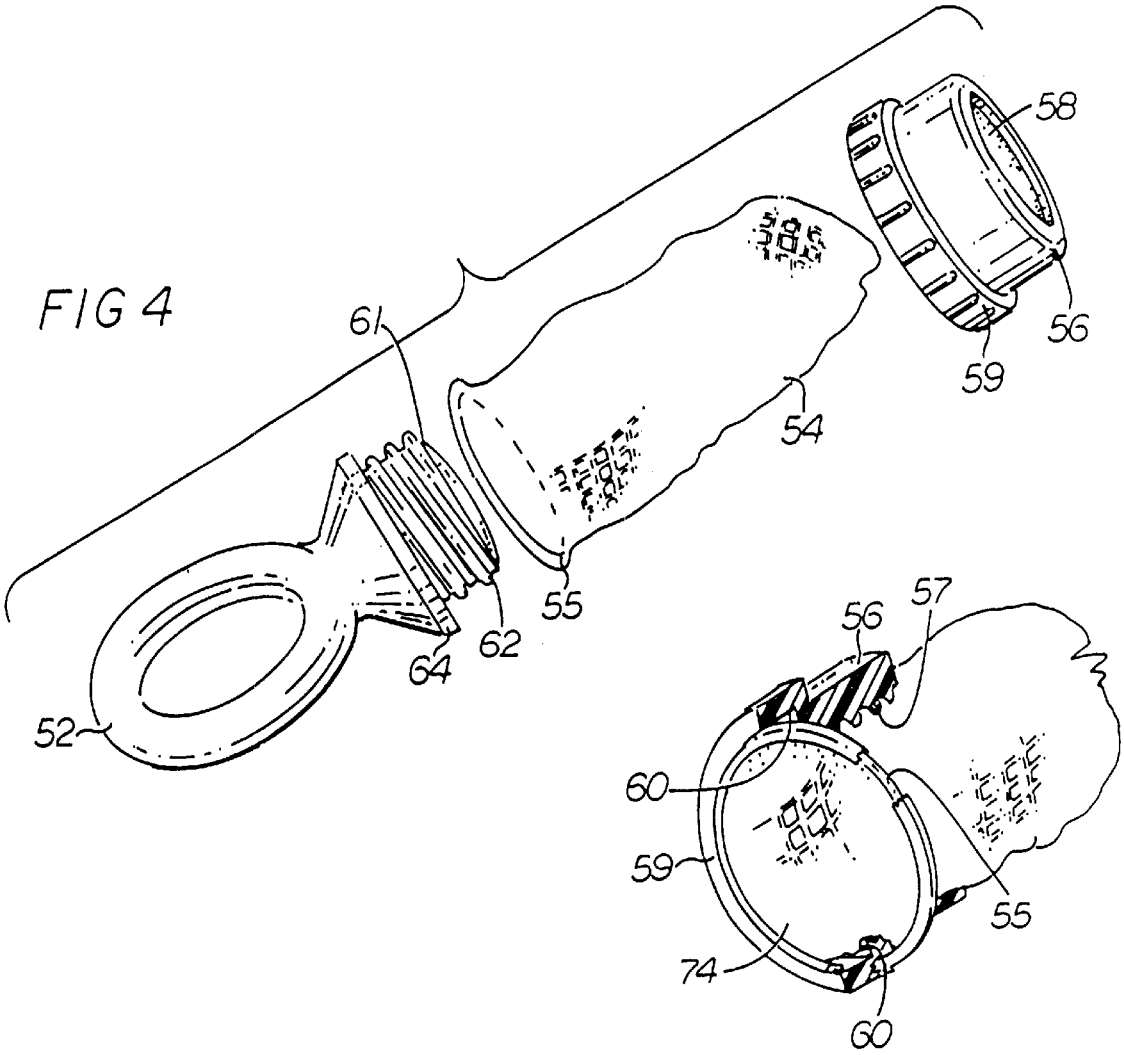
FIG 4a

BABY SAFE FEEDER WITH INTEGRAL MESH BAG

RELATIONSHIP TO PREVIOUS PATENT

This invention bears a close relationship to my earlier issued U.S. Pat. No. 5,364,348 entitled "Device for Supplying Food to a Person while Avoiding Choking," which issued on Nov. 15, 1994.

BACKGROUND OF THE INVENTION

Almost everyone is well aware of the fact that liquid food can be supplied to a child from a bottle provided with a nipple, with such nipple often being held in place by virtue of mounting the nipple in a ring that is equipped with internal screw threads. Used with this nipple and ring is a bottle having external threads extending around the open end, so that by tightly screwing the ring onto the top of the bottle, a liquid tight arrangement is brought about. After the milk, orange juice or other liquid food has been fully administered, the ring is unscrewed from the top of the bottle so that a thorough washing of all of these components can be readily brought about.

Typically the mother or other care giver introduces the infant to spoon feeding in the age range of six to eight months, but sometimes the transition from nipple to spoon can be difficult for the infant.

My earlier U.S. Pat. No. 5,364,348 provided a means whereby a transitional phase is set up during the baby's development between the milk-nipple stage and the food-spoon stage. The administering of certain foods, such as semi-solid foods, in the early period of development becomes easier because of the baby's familiarity with a nipple, and this makes subsequent spoon training faster and easier, because when a spoon is first presented with food in it, the baby will already be familiar with the food. Consequently, crossing the "spoon barrier" becomes a simple matter.

Another important consideration is the fact that when an infant is starting to take semi-solid and solid food, the possibility of choking can be a constant threat. Therefore, when a child is being given a piece of a hot dog, for example, the mother or other care giver should cut the hot dog longitudinally before cutting it into pieces. This is advisable because a generally cylindrically shaped piece of hot dog is of a configuration that could easily form a blockage in the throat of a child or impaired adult, and cause him or her to choke to death if help is not quickly forthcoming.

I am aware that there are many items on the market, such as baby crackers, baby cookies, baby toast and the like that are intended as snacks for an infant to chew on while teething or while the infant has only a few teeth. Even though such items are ostensibly for infants, it is nevertheless quite possible for an infant or impaired adult to break off a piece of such an item and choke on it.

In accordance with the teachings of my above-mentioned patent, I have provided a food dispensing member of fine mesh construction such that relatively soft, solid or semi-solid food items placed in the dispensing member can be dissolved by the person's saliva and thereafter ingested, this being accomplished without any possibility of the person choking upon such food or any part of the feeder device.

Although my earlier issued patent has been quite successfully marketed as a "Baby Safe Feeder," it is entirely possible that after a mother or other care give has washed out the food dispensing member of fine mesh construction and left it to dry in a location reachable by a child, the child could possibly grasp the mesh bag, place it in his or her mouth, and then choke on it.

It was in an effort to supplement and improve upon the safety of my previously patented device that the present invention was evolved.

SUMMARY OF THE INVENTION

In accordance with this invention, I provide a device for feeding food, typically semi-solid food, to a young child or to a person unable to manage the use of a fork or spoon, without the threat of the person choking. In other words, my invention is usable in the nursery, or in a location involving the administration of food by a care giver to a child, or to an adult with a physical or mental impairment.

This device comprises a handle member in combination with a food dispensing member in the form of an elongate container of fine mesh material that has an open end and a closed end. Through the open end semi-solid food can be inserted into the food dispensing member. The handle member has a generally circularly configured end upon which suitable securing means are disposed, with a ring member equipped with like means utilized in operative association with the handle member. In the preferred instance, the securing means take the form of threads, with internal threads on the ring member being readily able to be tightly interfitted with external threads of a like nature utilized on the circularly configured end of the handle. I provide suitable means for holding the aperture of the food dispensing member in a wide open position, with this means being of a diameter as to make it highly unlikely that the elongate container could be swallowed by a child or impaired adult. The insertion of semi-solid food into the food dispensing member is of course made easier because of its aperture being held in the wide open position.

The internally threaded ring or ring member has means enabling the aperture of the food dispensing member to be held in a secure relationship with respect to the circularly configured end of the handle member. As a consequence of this arrangement, upon semi-solid food being placed in the elongate container of mesh material, the internally threaded ring can be tightened upon the handle member so as to form a unitary device. The food dispensing member, upon then being placed in the mouth of the person, enables the food in latter member to at least partially dissolve in the mouth of the person.

In one embodiment of my invention, the internally threaded ring member takes the form of a ring assembly constituted by inner and outer interlocking ring portions, with the part of the food dispensing member adjacent the aperture of this member being locked tightly between the inner and outer ring portions. After being forced together, the ring portions become practically inseparable. The size of the interlocking ring portions is such as to make it virtually impossible for these to be swallowed.

In accordance with another embodiment of my invention, the aperture of the food dispensing member is held in a wide open position by a ring member in the form of a rigid ring. This rigid ring has a diameter slightly larger than the diameter of the circularly configured end of the handle member, upon which external threads are disposed, such that the rigid ring can be placed over the threads. An internally threaded ring serves to hold the rigid ring and the open end of the food dispensing member in firm engagement with the external threads of the handle member.

Like the embodiment involving the interlocked ring portions, the use of the rigid ring around the open end of the food dispensing member prevents it from being swallowed.

Examples of solid or semi-solid food that can be readily dissolved in the mouth of the person are pieces of bread, small pieces of cooked potato, pretzel pieces, Jello, certain cereals, cookie crumbs and rock candy. Further examples are carrots, apples, cooked or raw food and the like.

I typically construct the handle member of plastic, preferably a strong, industrial grade plastic, although I am not to be limited to this. Usually I create the mesh container out of suitable cloth.

It is thus to be seen that a primary object of this invention is to provide a feeding device for safely feeding an infant, small child or impaired adult by the use of an integral mesh bag in which semisolid food is contained, with such mesh bag being anchored to a ring-shaped member of sufficient size that it cannot be swallowed, even after the mesh bag has been removed from the handle member for washing.

It is another object of this invention to provide a feeding device of simple and straightforward configuration, that can be manufactured and marketed at a relatively low cost, yet forming an entirely safe feeding arrangement for a child or impaired adult.

It is yet another object of this invention to provide a food dispensing member of fine mesh construction such that relatively soft, solid or semi-solid food items placed in the integral dispensing member can be dissolved by the person's saliva and thereafter ingested, this being accomplished without any possibility of the person choking upon such food or at any time swallowing the dispensing member, even when the components have been separated for cleaning.

It is yet still another object of this invention to provide a means for tightly securing a food dispensing member of fine mesh construction upon a handle member, such that a child or impaired adult can readily learn to put the food dispensing member in his or her mouth and ingest the food value from the solid or semi-solid food placed in the dispensing member, without the subsequent separation of the food dispensing member from the handle member risking the person swallowing the dispensing member.

It is yet another object of this invention to provide a multi-component feeding device that can be easily assembled when ready to be put into use, but which can be readily disassembled for sterilization subsequent to use, with no danger of any component of my device being swallowed by a child or impaired adult.

These and other objects, features and advantages will become more apparent from a study of the appended figures of drawing.

BRIEF DESCRIPTION OF DRAWINGS

FIG. 1 is an assembled view of a first embodiment of my novel safe feeder, by the use of which semi-solid food able to be readily dissolved is placed in a food dispensing member in the form of an elongate member of fine mesh material, with this arrangement making it possible for certain foods to be safely administered to an infant, small child or impaired adult;

FIG. 2 is an exploded view of this first embodiment of my baby safe feeder, revealing in greater detail, the separate components that constitute this invention, which are the handle member and the ring member in the form of an internally threaded ring assembly able to be locked around the open end of the food dispensing member and engage the male threads disposed around one end of the handle member.

FIG. 2*a* is a fragmentary view to an enlarged scale showing how the internally threaded ring assembly, made up of inner and outer ring portions that lock around the open end of the food dispensing member;

FIG. 3 is an assembled view of a second embodiment of my novel safe feeder, in which the elongate member of fine mesh material is secured in its operative relationship with the handle member;

FIG. 4 is an exploded view of this second embodiment of my baby safe feeder, revealing in greater detail, the separate components that constitute this invention, which are the handle member, the internally threaded ring able to be locked around the open end of the elongate food dispensing member of fine mesh material, and the food dispensing member having a ring member in the form of a rigid ring attached to its open end, with the utilization of this rigid ring making it essentially impossible for the food dispensing member to be swallowed; and.

FIG. 4*a* is an enlarged view revealing how the rigid ring installed in the end of the elongate food dispensing member of fine mesh material is intended to fit inside an internal slot or groove formed in the open end of the encircling ring, so that upon the ring being tightened onto the threaded end of the handle member, the rigid ring will fit tightly against the shoulder extending around the periphery of the handle member.

DETAILED DESCRIPTION

With initial reference to FIG. 1, it will be seen that I have illustrated a first embodiment of my safe feeding device 10 in its fully operative position, such that readily dissolvable food may be administered to a child or impaired adult without the threat of choking. The device 10 comprises a handle member 12 that can be readily grasped by the child or impaired adult, with this handle member being utilized in combination with a food dispensing member 14. The food dispensing member 14 may take the form of an elongate member or container of fine mesh material, one end of which is firmly yet removably fastened to the handle member 12 by the use of a ring member R. In the embodiment of FIG. 1, the ring member takes the form of an encircling ring assembly 16 whose construction will shortly be described at greater length.

Clearly visible in FIG. 1 as well as in FIG. 2 is the handle member 12, which is typically of plastic, preferably of a strong, industrial grade plastic that can resist being brought to sterilization temperatures a large number of times without significantly deteriorating. The handle 12 may be provided with an aperture 13 to facilitate it being grasped by the person holding the device.

In FIG. 2 it is important to note from this exploded view that the handle member 12 has a generally circularly configured end 21 thereon, around which circular end, ring mounting means are disposed. As will be noted, I prefer for the ring mounting means or securing means to take the form of external screw threads 22 on the circularly configured end of the handle member 12. A flange 24 is located at the base or innermost portion of the threads 22, which is provided for a purpose described hereinafter.

In FIG. 2 are revealed further details of the ring member R, with it to be noted from this figure that the ring assembly 16 is made up of inner and outer interlocking ring portions 18 and 20. The outer diameter of the inner ring portion 18 is such that it can be fitted into the outer ring portion 20 only with some difficulty. After the inner and outer ring portions have been interfitted with the outer end of the member 14 therebetween, it becomes exceedingly difficult for the ring portions to become separated.

The interior of the inner ring portion 18 is equipped with internal means such that it can be tightly interfitted upon the ring mounting means of the handle member 12. I prefer for the internal means of the inner ring portion 18 to take the form of internal threads 26 that are created so as to threadedly engage the external screw threads 22 at the end 21 of the handle member 12. The outer ring portion 20 has a generally circularly-shaped aperture 28 therein, the diameter of which is determined by the flange 16A that extends around one end of the ring.

With continuing reference to FIG. 2, and with particular regard to the food dispensing member 14, it can be seen to be an elongate container of fine mesh material having a closed end 32, but having an open end 34. The member 14 may be of cloth, such as nylon or polyester, although certain closely woven plastic meshes may also be utilized in certain circumstances.

The open end 34 of the mesh bag 14 is of a diameter such that it can fit around the flange 19 of the inner ring portion 18 and then be inserted through the aperture 28 in the outer ring portion 20. It is because of this arrangement that the open end of the food dispensing member 14 is locked tightly between the closely fitted inner and outer ring portions 18 and 20 of the ring assembly 16. As a matter of fact, the open end 34 of the food dispensing member 14 is locked so tightly between the interfitted inner and outer ring portions that a tool in the nature of a prybar would be required to separate the food dispensing member from the inner and outer ring portions. In such event, damage to the mesh bag would be likely.

It is important to note that the diameter of the internally threaded ring assembly 16, made up of the interfitted inner and outer ring portions 18 and 20 is such that it would be nearly impossible for the ring assembly to be swallowed by a person. It is because of this feature that the mother or other care giver can safely launder the food dispensing member 14 without the fear of this member being swallowed by a child or an impaired adult should the member 14 and the tightly attached ring assembly 16 be inadvertently left, after use, in an easily reached position. I have found that the food dispensing member 14 can survive a large number of washings without becoming separated from the ring assembly 16.

With reference to FIG. 2*a,* it will there be seen that I have indicated how the open end 34 of the food dispensing member passes around the flange 19 of the inner ring portion 18, and then passes between the tightly fitted inner and outer ring portions. As the handle 12 is thereafter screwed into the threads of ring 18, the flange 24 on handle 12 will have the effect of pushing up on flange 16A of outer ring 20 while at the same time the threads 22 pull down on inner ring 18, thus tightly pinching food dispersing member 14 at point A in FIG. 2*a*.

It is thus to be seen that by this arrangement, the inner and outer ring portions of the ring assembly 16 are drawn even closer together when the encircling ring assembly 16 is tightened upon the external threads 22 of the handle member 12, which is a far better arrangement than would be the case had the tightening of the ring assembly 16 involved a tendency for the inner and outer ring portions to move apart.

I am not limited to any particular size of the elongate food dispensing member 14, but the length of the member is typically two or three times as great as its diameter.

As will be obvious, the length of the effective portion of the elongate food dispensing member 14 is decided at the time the inner and outer ring portions 18 and 20 are forced together. This is true because the inner and outer ring portions interfit so tightly that the food dispensing member 14 might well be damaged as a consequence of a determined effort thereafter being made to separate the inner and outer ring portions so that the effective length of the food dispensing member 14 could be readjusted.

As can be easily seen, readily dissolved food items may be inserted into the food dispensing member or mesh bag 14 through the open end 34 thereof, with such food items being in the nature of pieces of bread, pieces of cookie, potato, pieces of pretzel, jello and other solid or semi-solid foods. Upon the handle 12 being attached and the person then placing the elongate container 14 in his or her mouth, the person can commence receiving nutrition shortly after the food items become saturated with his or her saliva or chewed into small enough pieces to pass through the mesh bag. The mesh is of fine enough weave as to assure no large particles coming through that would pose a choking-type jeopardy to the person.

After the person removes the feeding device or falls asleep, the mother or other care giver can remove the feeding device and then proceed to unscrew the ring assembly 16 so that any remaining pieces of food in the elongate mesh container 14 can be removed either by shaking, or by turning the elongate container inside out. Thereafter all of the components 12, 14 and 16 can be sterilized for subsequent use. As previously made clear, the ring assembly 16 is made up of inner and outer ring portions 18 and 20 remains tightly interfitted with the elongate mesh bag 14 during the cleaning or washing process. The ring assembly 16 is obviously too large to be swallowed.

The size of the mesh opening of the elongate food dispensing member utilized in a given instance can be chosen with regard to the physical size and health of the person involved. Typically, a relatively small mesh would be utilized with an infant, whereas a larger mesh could be utilized by a care giver when feeding an adult with a physical or mental impairment.

Some embodiments of the mesh utilized in accordance with my invention have involved something on the order of eight openings per lineal inch, whereas other embodiments have had approximately eighteen openings per lineal inch. Stated in terms of openings per square inch, these can range between 64 openings and 324 (or more) openings per square inch.

In FIG. 3 I depict an embodiment of my safe feeding device that involves a somewhat different arrangement for assuring that the elongate food dispensing container does not separate from a component that is too large for an infant or impaired adult to swallow.

The safe feeding device 50 in FIG. 3 involves a handle member 52, attached to which is a food dispensing member or mesh bag 54. The elongate food dispensing container is held to the handle member 52 by means of a ring member R which, in this instance, is an internally threaded encircling ring 56.

With reference to FIG. 4 it will be noted that the handle member 52 has been provided with external screw threads 62, which extend around the circularly configured end 61. A flange 64 on the a handle member extends around the base of the external threads 62.

It will be noted in FIG. 4 but in greater detail in FIG. 4*a* that I utilize a rigid ring 55 around the open end 74 of the food dispensing container or mesh bag 54. The rigid ring 55 is integral with the end of the mesh bag 54 and cannot be separated from the bag without destroying the bag insofar as any useful purpose is concerned. For example, the rigid ring may be stitched into the open end of the bag 54; it could be glued in position; or it may be sonic welded. Regardless of the method used, it will be permanently attached to the open end of elongate container 54 so as to hold the end open to facilitate placing the food into the mesh bag 54, in addition to assisting in securing the mesh bag 54 to the handle 52. As another alternative, depending on the material of which the bag is made, the rigid ring may be molded into the open end of the bag.

It is important to note that the rigid ring 55 is of such a diameter that it cannot be swallowed by an infant or impaired adult.

As can be seen in FIG. 3 but in greater detail in FIG. 4*a*, the ring member R, in this instance the encircling ring 56 is provided with internal threads 57 that will readily engage the external screw threads 62 of the handle member 52. In addition, the encircling ring 56 is provided with a flange 59 that may be regarded as offset from the main portion of the ring 56. In other words, the flange 59 has a greater diameter than does the main portion of the ring, such that an internally disposed circular slot 60 is created around the interior of the end of the ring 56.

After the food dispensing member or mesh bag 54 has been inserted through the central aperture 58 in the ring 56, the rigid ring 55 comes to rest in the circular slot 60, with the rigid ring being too large to enter the main portion of the encircling ring 56.

When the rigid ring 55 is residing in the circular slot 60, and the internal threads 57 of the ring 56 have been caused to engage the external screw threads 62 on the handle member 52, the flange 59 of the rigid ring 56 will be caused to move into a relationship in which the flange 59 surrounds the flange 64 located on the handle member 52, with this detail being best illustrated in FIG. 3. As a consequence of the encircling ring 56 being screwed tightly into contact with the handle member, the rigid ring 55 of the mesh bag 54 will be held closely against the flange 64 by the ring 56 so as to make it impossible for the user to pull the food dispensing member 54 loose from handle 52. The mesh material permanently affixed to the rigid ring 55 will be held tightly between the flange 64 of handle 52 and the internal slot 60 of the ring 56, thus making any leakage at this location highly unlikely.

It should now be apparent that both of the embodiments of my invention are of such a nature as to make it well nigh impossible for the food dispensing member or elongate mesh container to be swallowed should the mother or care giver leave such mesh bag within easy reach of the child or impaired adult after the residual food has been removed from the bag.

I Claim:

1. A device for feeding a young child or impaired adult without the threat of the person choking, said device comprising a handle member in combination with a food dispensing member in the form of an elongate container of mesh material, in the end of which container, an aperture is located so that semi-solid food can be inserted into said elongate container, said handle member having a circularly configured handle end around the exterior surface of which, securing means are disposed, a ring utilized in operative association with said handle end, around the interior surface of which ring, securing means complementary to the securing means on said handle end are disposed, with the securing means of said handle end and said ring able to interfit and be tightened so as to be interlocked together, means serving to hold said aperture of said elongate container in an open position to simplify the placement of food in said container, with said means being of a diameter as to make it highly unlikely that said elongate container could be swallowed by a child or impaired adult, whereby upon food being placed in said container, said ring can be tightened upon said handle end so as to form a unitary device, said elongate container, upon then being placed in the mouth of the person, enabling the food in said container to at least partially dissolve in the mouth of the person.

2. The device for feeding a young child or impaired adult without the threat of the person choking as recited in claim 1 in which said securing means disposed on the exterior of said handle end and on the interior of said ring are screw threads.

3. The device for feeding a young child or impaired adult without the threat of the person choking as recited in claim 1 in which said ring is part of a ring assembly constituted by inner and outer interlocking ring portions, with the part of said elongate container adjacent said aperture being locked tightly in a non-separable manner between the ring portions constituting said ring assembly.

4. The device for feeding a young child or impaired adult without the threat of the person choking as recited in claim 1 in which the aperture of said elongate container is held in the open position by a rigid ring, said rigid ring having a diameter slightly larger than the diameter of said circularly configured handle end upon which external threads are disposed, whereby said rigid ring can be placed over and around said threads, and means for holding said rigid ring and the end of said elongate container in firm engagement with said handle end.

5. The device for feeding a young child or impaired adult without the threat of the person choking as recited in claim 4 in which said means for holding said rigid ring and the end of said elongate container in firm engagement with said handle end is said ring.

6. The device for feeding a young child or impaired adult without the threat of the person choking as recited in claim 4 in which a flange is provided adjacent said external threads of said handle end, and said rigid ring has a portion coming into tight contact with said flange at such time as said internally threaded ring has been tightened, assuring that said elongate container will be secured to said handle end in an essentially unitary manner.

7. A device for feeding a young child or impaired adult without the threat of the person choking, said device comprising a handle member in combination with an elongate food dispensing member of mesh material, in the end of which mesh container, an aperture is located so that semi-solid food can be inserted into said mesh container, said handle member having a circularly configured handle end around the exterior surface of which, securing means are disposed, a ring member utilized in operative association with said handle end, around the interior surface of which ring member, securing means complementary to the securing means on said handle end are disposed, with the securing means of said handle end and said ring member able to interfit an d be tightened so as to be interlocked together, means serving to hold said aperture of said mesh container in an open position to simplify the placement of food in said mesh container, with the diameter of said means being sufficiently large as to make it highly unlikely that said mesh container could be swallowed by a child or impaired adult, whereby upon food being placed in said mesh container, said ring member can be tightened upon said handle end so as to form a unitary device, said mesh container, upon then being placed in the mouth of the person, enabling the food in said mesh container to at least partially dissolve in the mouth of the person.

8. The device for feeding a young child or impaired adult without the threat of the person choking as recited in claim 7 in which said ring member i s part of a ring assembly constituted by inner and outer interlocking ring portions, with the part of said mesh container adjacent said aperture being locked tightly in a non-separable manner between the ring portions constituting said ring assembly.

9. The device for feeding a young child or impaired adult without the threat of the person choking as recited in claim 7 in which the aperture of s aid mesh container is held in the open position by a rigid ring, said rigid ring having a diameter slightly larger than the diameter of said circularly configured handle end upon which external threads are disposed, whereby said rigid ring can be placed over and around said threads, and means for holding said rigid ring and the end of said mesh container in firm engagement with said handle end.

10. The device for feeding a young child or impaired adult without the threat of the person choking as recited in claim 9 in which said means for holding said rigid ring and the end of said mesh container in firm engagement with said handle end is said ring member.

11. The device for feeding a young child or impaired adult without the threat of the person choking as recited in claim 9 in which a flange is provided adjacent said external threads of said handle end, and said rigid ring has a portion coming into tight contact with said flange at such time as said internally threaded ring has been tightened, assuring that said mesh container will be secured to said handle end in an essentially unitary manner.

* * * * *